US005310179A

United States Patent [19]

Takatsuka

[11] Patent Number: 5,310,179

[45] Date of Patent: May 10, 1994

[54] TENNIS RACKET

[75] Inventor: Masanori Takatsuka, Hamamatsu, Japan

[73] Assignee: Yamaha Corporation, Japan

[21] Appl. No.: 921,567

[22] Filed: Jul. 29, 1992

[30] Foreign Application Priority Data

Jul. 29, 1991 [JP] Japan ..... 3-210360
May 20, 1992 [JP] Japan ..... 4-152702

[51] Int. Cl.[5] ..... A63B 49/02
[52] U.S. Cl. ..... 273/73 C
[58] Field of Search ..... 273/73 R, 73 C, 73 D, 273/73 E, 73 G

[56] References Cited

U.S. PATENT DOCUMENTS 4,437,662 3/1984 Soong .
4,512,575 4/1985 Tzeng ..... 273/73 C X
4,662,634 5/1987 Winkler ..... 273/73 C X
4,834,383 5/1989 Wuehrle et al. ..... 273/73 C
4,964,635 10/1990 Fitzgerald ..... 273/73 C
4,997,186 3/1991 Carr ..... 273/73 C

FOREIGN PATENT DOCUMENTS 0013595 7/1980 European Pat. Off. ..... 273/73 C
56-31765 3/1981 Japan .
57-115271 7/1982 Japan .
58-216077 12/1983 Japan .

*Primary Examiner*—Vincent Millin
*Assistant Examiner*—Raleigh W. Chiu
*Attorney, Agent, or Firm*—Ostrolenk, Faber, Gerb & Soffen

[57] ABSTRACT

In construction of a tennis racket provided with an oval Head Frame defining a racket face, the longitudinal size ($W_1$) of the racket face is set to a value in a range from 320 to 390 mm, the transverse size ($W_2$) of the same is set to a value in a range from 200 to 240 mm, and the longitudinal compressive rigidity of the head frame is adjusted to a value in a range from 30 to 200 Kgf/mm. The construction thus specified allows employment of an enlarged main/cross string tension ratio which assures high degree of spin performance at shooting balls.

16 Claims, 9 Drawing Sheets

TENNIS RACKET

BACKGROUND OF THE INVENTION

The present invention relates to a tennis racket, and more particularly relates to improvement in spin performance of the face of a tennis racket at shooting balls.

In general construction of a tennis racket, a substantially oval ring shaped head frame defines a face constructed by a string network and the string network is made up of interlaced main (longitudinal) and cross (transverse) strings mounted under tension to the head frame. The main strings are usually kept under a tension in a range from 26 to 30 kg and the string tension ratio ($T_1/T_2$), i.e. the ratio of the main string tension ($T_1$) to the cross string tension ($T_2$), is set to a value in a range from 1/1 to 2/1. By setting the string tension ratio to a value in this range, the main and cross string tensions well balance so that the head frame after string setting should preserve its original shape before string setting.

Among various performances of a tennis racket at shooting ball, high degree of spin performance is required by players, in particular by high level players. Here, the term "spin performance" refers to an operation of a racket face to rotate a ball in a direction intended by a player at shooting. For example, top spin causes intensive forward rotation of a ball and back spin causes intensive rearward rotation of a ball.

It is well known in the field of art that spin efficiency, i.e. the degree of spin performance on a ball, is dependent upon the magnitude of the friction force acting on the ball from the face at the very moment of collision. It is also confirmed that, with the above-described construction of a racket face, about one half of the normal reaction acting on a ball at shooting is lost without any contribution to its friction force. Here, the term "normal reaction" refers to a reactive force acting on a ball in a direction normal to the racket face shooting the ball. In order to increase the degree of such a contribution, it is helpful to increase the value of the above-described main/cross string tension ratio ($T_1/T_2$).

Now, the value of compressive rigidity of a head frame is in a range from 12 to 18 Kgf/mm when measured in the direction of main strings. For this measurement, a tennis racket is fixed at the heel of its grip and a load of 10 Kg is applied to the crown of its head frame.

As stated already, the main/cross string tension ratio is conventionally set to a value in a range from 1/1 to 2/1 for stable balance between main and cross string tensions. When the string tension ratio exceeds this limit, unduly increased main string tension would cause longitudinal compression and lateral expansion of the head frame. Such deformation in excess tends to cause breakage of the head frame. Even when no serious breakage is caused, such deformation causes undesirable disorder in main/cross tension balance on the racket face.

Regarding the mechanism of the above-described spin performance of a racket face, it was confirmed by the inventor of the present invention that the degree of spin performance is closely related to dynamic behaviour of a ball and a racket face at mutual collision. More specifically, the most important factor in spin performance is created by the correlationship between the main/cross string tension ratio ($T_1/T_2$) and the mode of distribution of normal reaction, i.e. normal reactive force, from the racket face.

The values of main and cross string normal reactions are given as follows. It is here assumed that a ball is shot at an intersection of a main string with a cross string in a racket face. Then, the normal reaction ($N_1$) of the main string is given by;

$$N_1=(4T_1/L_1)\cdot X_1 \quad (1)$$

$L_1$: length of the main string $X_1$: displacement of the main string in the normal direction.

Whereas, the normal reaction ($N_2$) of the cross string is given by;

$$N_2=(4T_2/L_2)\cdot X_2 \quad (2)$$

$L_2$: length of the cross string $X_2$: displacement of the cross string in the normal direction.

The total normal reaction (N) acting on the ball is then given by;

$$N=N_1+N_2 \quad (3)$$

In the construction of a conventional tennis racket, its racket face is designed to suffice the following relationship;

$$L_2/L_1 \approx T_2/T_1 \quad (4)$$

From this equation, the following relationship is deduced;

$$T_2/L_2=T_1/L_1=\text{constant} \quad (5)$$

This equation endorses an inference that the normal reaction ($N_2$) from the cross strings is roughly equal in amount to the normal reaction ($N_1$) from the main strings. This inference is believed to be safely propagated to the entire area of a racket face and the total reaction acting on a ball at collision is almost equally shared by its main and cross strings.

When striking of a ball against a racket face is microscopically analyzed as a mechanical model, the general collision consists of its impact contact with main strings and its impact contact with cross strings. At these impact contacts, a frictional force acts on the ball from the face and this frictional force (F) is given by;

$$F=F_1+F_2 \quad (6)$$

$F_1$: frictional force from the main strings $F_2$: frictional force form the cross strings Then, when the above-described normal reactions $N_1$ and $N_2$ are taken into consideration, these values are given by;

$$F_1=\mu_1 N_1 \quad (7)$$

$$F_2=\mu_2 N_2 \quad (8)$$

$$\therefore F=\mu_1 N_1+\mu_2 N_2 \quad (9)$$

Here, $\mu_1$ indicates the dynamic friction coefficient between the ball and the main strings in the lateral direction of the latter whereas $\mu_2$ indicates the dynamic friction coefficient between the ball and the cross strings in the longitudinal direction of the latter.

When attention is directed to one string in a racket face, its dynamic friction coefficient in the lateral direction is apparently far greater than its dynamic friction coefficient in the longitudinal direction. Taking into consideration the fact that, in construction of a common racket face, its main strings and cross strings are usually made of a same material and that, as a consequence, same in physical properties, this relationship between the lateral and longitudinal dynamic friction coefficients can be safely applied to the relationship of the above-described equation (9).

Thus, when compared with the degree of influence of the normal reaction ($N_1$) of the main strings on the total frictional force (F) acting on the ball, the degree of influence of the normal reaction ($N_2$) of the cross strings is quite small. In the case of the conventional racket face, the normal reaction ($N_2$) from the cross strings roughly equals in amount the normal reaction ($N_1$) from the main strings as inferred on the basis of the above-described equation (5). Stated otherwise, as briefed already, about half of the total normal reaction (N) is wasted without any contribution to creation of the frictional force which is useful for raising spin performance of the racket face.

On the basis of the foregoing analysis, it was first intended by the inventor of the present invention to increase the frictional force (F) acting on a ball from a racket face by means of raising the ratio ($N_1/N_2$) of the normal reaction ($N_1$) of the main strings to the normal reaction ($N_2$) of the cross strings. Rise in this ratio ($N_1/N_2$) satisfies the following relationship;

$$N_1/N_2 > 1 \quad (10)$$

Here, the above-described increase in frictional force (F) intended by the inventor is resulted from a combination of the relationship in dynamic friction coefficient ($\mu_1 > \mu_2$) with the relationship in normal reaction ($N_1 > N_2$).

From the equations (1) and (2), the normal reaction (N) of a string is generally given by;

$$N = (4T/L) \cdot x \quad (11)$$

T: string tension

L: length of the string concerned x: displacement of the string in the normal direction.

As is clear from this relationship, the magnitude of the normal reaction (N) is proportional to the magnitude of the string tension (T). Consequently, rise in normal reaction ratio ($N_1/N_2$) can be achieved by rise in string tension ratio ($T_1/T_2$). In other words, the larger the string tension ratio ($T_1/T_2$), the larger the normal reaction ratio ($N_1/N_2$).

As stated above, the conventional tennis racket is generally designed so that the value of compressive rigidity of its head frame is in a range from 12 to 18 Kgf/mm when measured in the direction of its main strings. When the string tension ratio ($T_1/T_2$) is increased carelessly, resultant main string tension would be increased to cause longitudinal compression and lateral expansion of the head frame. As stated already, such deformation in excess is liable to cause breakage of the head frame or serious disorder in main/cross tension balance on the racket frame.

SUMMARY OF THE INVENTION

It is the basic object of the present invention to enhance spin performance of the face of a tennis racket without posing any malign influences on the head frame construction and face tension balance.

In accordance with the basic aspect of the present invention, the face of a tennis racket has the first length ($W_1$) in the direction of its main strings adjusted in a range from 320 to 390 mm and the second length ($W_2$) in the direction of its cross strings adjusted in a range from 200 to 240 mm, and the head frame of the tennis racket has a compressive rigidity in the direction of the main strings adjusted in a range from 30 to 200 Kgf/mm.

In one preferred embodiment of the present invention, the head frame of the tennis racket has a transverse cross sectional profile of a rigidity which provides a substantially constant stress distribution over its entire circumferential length when the main string tension ($T_1$) is 27 Kg or larger and the main/cross string tension ratio ($T_1/T_2$) is in a range from 3/1 to 15/1.

In another preferred embodiment of the present invention, the size of the head frame taken in a direction parallel to the racket face is 18 mm or larger, more preferably 20 mm or larger, over a length of at least 20 mm within a circumferential area of 80 mm from its crown; and/or the size of the head frame taken in a direction parallel to the racket face is 16 mm or larger, more preferably 18 mm or larger, over a length of at least 20 mm within circumferential areas of 110 to 210 from its crown; and/or the size of the head frame taken in a direction parallel to the racket face is 15 mm or larger, more preferably 17 mm or larger, within circumferential areas of 110 to 210 mm from the center of its yoke; and/or the size of the head frame taken in a directional parallel to the racket face is 18 mm or larger, more preferably 20 mm or larger, over a length of at least 20 mm within a circumferential area of 80 mm from the center of its yoke.

In the other preferred embodiment of the present invention, the size of the head frame taken in a direction parallel to said racket face within a circumferential area of 80 mm from its crown is by 50% larger than the minimum size taken in a same way; and/or the size of the head frame taken in a direction parallel to the racket face within circumferential areas of 110 to 210 mm from the crown is by 50% larger than the minimum size; and/or the size of the head frame taken in a direction parallel to the racket face within circumferential areas of 110 to 210 mm from the center of its yoke is at least partially by 50% larger than the minimum size and/or the size of the head frame taken in a direction parallel to racket face within circumferential area of 80 mm from the center of its yoke is by 50% larger than the minimum size.

DESCRIPTION OF THE PREFERRED EMBODIMENTS

Figure 1:
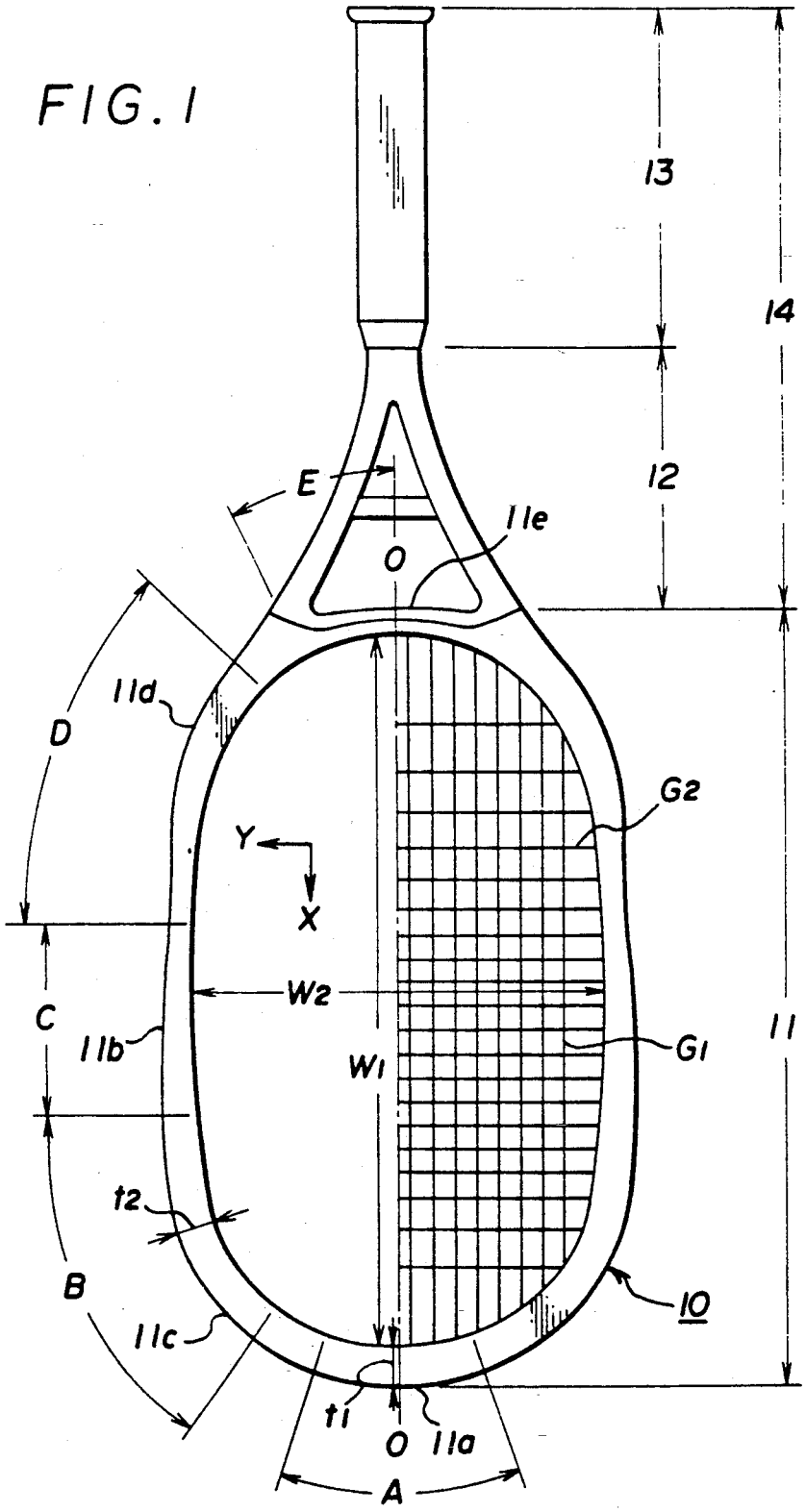
FIG. 1 is a plan view of one embodiment of the tennis racket in accordance with the present invention.

One embodiment of the tennis racket in accordance with the present invention is shown in FIG. 1, in which a tennis racket 10 has a shell construction make of, for example, carbon fiber reinforced plastics (CFRP). The tennis racket 10 includes a head frame 11 defining a racket face which is constructed by interlaced main (longitudinal) strings $G_1$ and cross (transverse) strings $G_2$ mounted under tension to the head frame 11, and a shaft 14 made up of a throat 12 and a grip 13.

In the area of the head frame 11, the longitudinal size $W_1$ of the racket face, i.e. the size of the racket face taken in the direction of the main strings $G_1$, is in a range from 320 to 390 mm. Whereas, the transverse size $W_2$ of the racket face, i.e. the size of the racket face taken in the direction of the cross strings $G_2$, is in a range from 200 to 240 mm.

Figure 2:
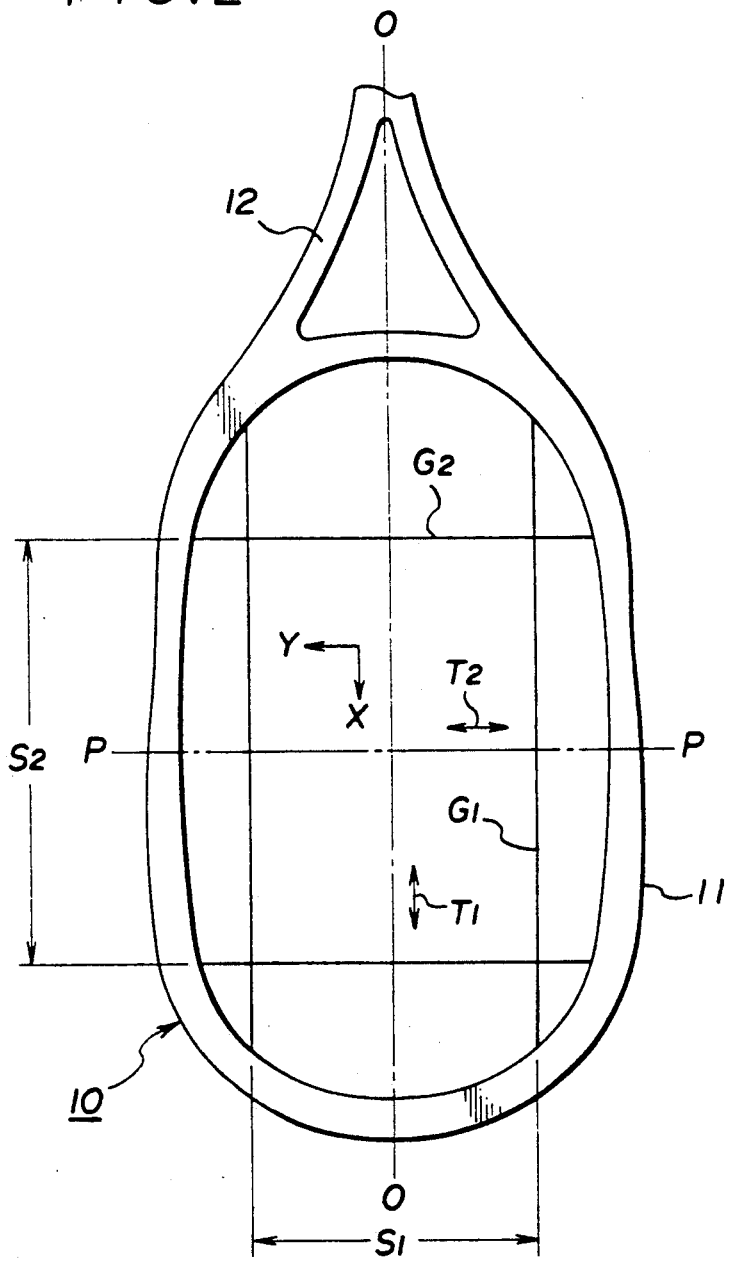
FIG. 2 is a plane view of the head frame of the tennis racket shown in FIG. 1.

The head frame 11 has an oval outer shape which is close to a square profile. The oval configuration has a longitudinal axis of symmetry O—O and a transverse axis of symmetry P—P as shown in FIG. 2. The length $L_1$ of the main strings $G_1$ is chosen so that, within the first span $S_1$ of 130 mm width extending equally on both sides of the longitudinal axis of symmetry O—O, its minimum/maximum ratio is 90% or larger. Whereas, the length $L_2$ of the cross strings $G_2$ is chosen so that, within the second span $S_2$ of 200 mm width extending equally on both sides of the transverse axis of symmetry P—P, its minimum/maximum ratio is 90% or larger.

Again in FIG. 1, the head frame 11 includes the first section A extending equally on both sides of its crown 11*a*, the second sections B extending over the crown side shoulders 11*c*, the third sections C extending over the intermediate sides 11*b*, the fourth sections D extending over the yoke side shoulders 11*d* and the fifth sections E extending equally on both sides of the center 11*e* of the throat 12 (yoke).

With such a construction of the head frame 11, it is now assumed that the main string tension ($T_1$) is set to a value in a range from 27 to 41 Kg. When the main/cross string tension ($T_1/T_2$) is set to a value in a range from 3/1 to 15/1 under this condition, the main/cross tension balance would be lost. In particular, the increased main string tension $T_1$ would cause a large compressive deformation of the head frame 11 in the longitudinal direction X which is parallel to the racket face.

When such compressive deformation is developed, the maximum stress concentration occurs in the area of the above-described first section A and the magnitude of stress diminishes as the area leaves from the crown 11*a*. The stress becomes minimum at a spot of about 90 mm from the crown 11*a* and maximum in the second section B of 130 to 190 mm from the crown 11*a*. The stress again diminishes in the third section C. A similar stress distribution exists in the areas of the fourth and fifth sections D and E.

With such a stress distribution, it is required to minimize the compressive deformation of the head frame 11 even when the main string tension $T_1$ is in a range from 27 to 41 Kg and the main/cross string tension ratio ($T_1/T_2$) is in a range from 3/1 to 15/1. In order to suffice this requirement, a thickness $t_1$ of the head frame 11, i.e. the size of the head frame 11 taken in a direction parallel to the racket face, should preferably be 18 mm or larger, more preferably 20 mm or larger, within the first section A of 80 mm from the crown 11*a*. Additionally, a like thickness $t_2$ of the head frame 11 should preferably be 16 mm or larger, more preferably 18 mm or larger, within the second section B of 110 to 210 mm from the crown 11*a*.

Similar thickness adjustment is required in the areas of the fourth and fifth sections D and E. More specifically, the thickness of the head frame 11 in the fourth section D of 110 to 210 mm from the center 11*e* of the throat 12 (yoke) should preferably be 15 mm or larger, more preferably 17 mm or larger. This thickness may cover either all or a part of the fourth section D. The thickness of the head frame 11 in the fifth section E of 40 mm on respective sides from the center 11*e* of the throat 12 (yoke) should preferably be 18 mm or larger, more preferably 20 mm or larger. This thickness may cover either all or a part of the fifth section E.

Through such a thickness adjustment, the longitudinal compressive rigidity of the head frame 11 can be set to a value in a range from 30 to 200 Kgf/mm. Such compressive rigidity of the head frame 11 allows a tension setting in which the main string tension $T_1$ is in a range from 27 to 41 Kg and the main/cross tension ratio ($T_1/T_2$) is in a range from 3/1 to 15/1. The above-described compressive rigidity further brings about a uniform stress distribution over the entire circumferential length of the head frame.

The above-described longitudinal compressive deformation of the head frame can generally be minimized by increasing the flexural rigidity (EI) of the material, more specifically CFRP used for production of the tennis racket, which is in turn enlarged by increasing the modulus of elasticity (EI) and the section modulus (I).

Figure 3:
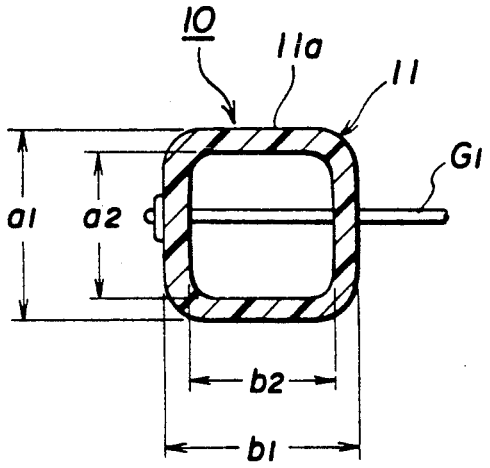
FIG. 3 is a transverse cross sectional view of the head frame shown in FIG. 2.

When the head frame 11 of a tennis racket has a construction shown in FIG. 3, its section modulus (I) is given by;

$$I=(a_1b_1^3-a_2b_2^3)/12 \quad (12)$$

$a_1$: outer shell thickness in the ball shooting direction
$a_2$: inner shell thickness in the ball shooting direction
$b_1$: outer shell thickness in the racket face direction $b_2$: inner shell thickness in the racket face direction. From this equation, it is clear to be most effective to increase the outer shell thickness ($b_1$) in the racket face direction in order to enlarge the section modulus (I) of the head frame 11.

In accordance with the basic concept of the present invention, the first length ($W_1$), i.e. the length of the racket face in the longitudinal direction, is set to a value in a range from 320 to 390 mm, the second length ($W_2$), i.e. the length of the racket face in the transverse direction, is set to a value in a range from 200 to 240 mm, and the compressive rigidity in the direction of the main strings is set to a value in a range from 30 to 200 Kgf/mm. Thanks to this construction, the main/cross string tension ratio ($T_1/T_2$) can be set to a value in a range from 3/1 to 15/1 even when the main string tension $T_1$ is chosen in a range from 27 to 41 Kg. This main/cross string tension ratio ($T_1/T_2$) assures remarkably high degree of spin performance at shooting balls by the tennis racket. One example of the method for measurement of the compressive rigidity is explained later in detail.

Figure 4:
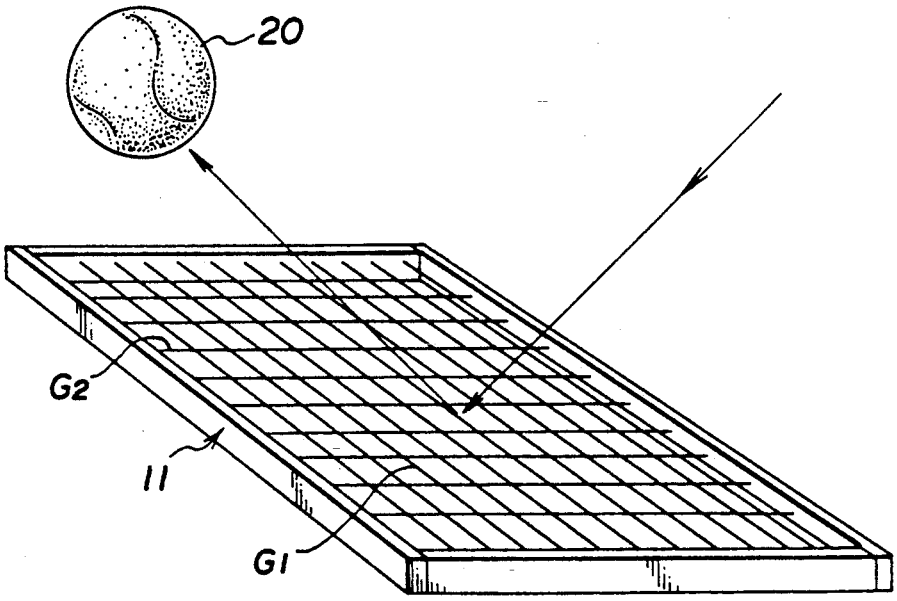
FIG. 4 is a perspective view of one example of a ball striking a vis racket face at ball shooting.

One practical method for investigating the relationship between the main/cross string tension ratio ($T_1/T_2$) and the degree of spin performance is illustrated in FIG. 4. A rectangular frame of an adjustable size is used as a model for the head frame 11 in the experiment. The longitudinal length $W_1$ is set to 310 mm, the transverse length $W_2$ is set to 230 mm and the surface area of the racket face is accordingly set to 110 inch$^2$. The main and cross strings $G_1$, $G_2$ are set at various main/cross string tension ratios ($T_1/T_2$). A ball 20 is thrown against the racket face at an angle of incidence of 45 degrees and at a speed of 110 Km/h and resultant degree of spin performance is recorded in the form of the number of rotation (rpm) of the ball 20 after rebound.

Figure 5:
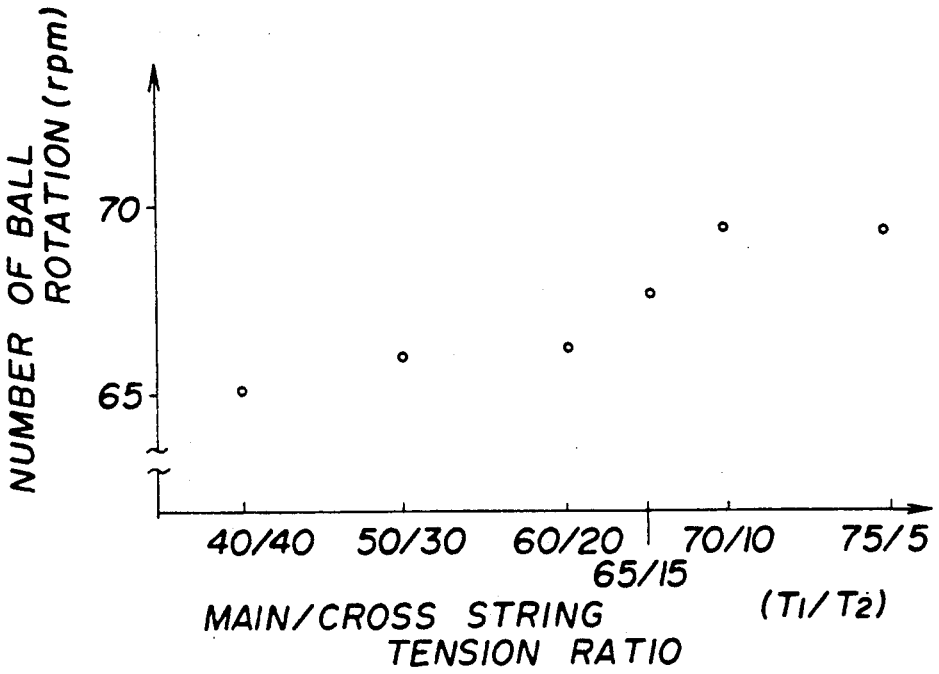
FIG. 5 is a graph for showing the relationship between the main/cross string tension ratio and the spin performance of a tennis racket at shooting balls.

The result of the experiment is shown in FIG. 5. It is clear from this graph that the corelation appears significant as the main/cross string tension ratio ($T_1/T_2$) exceeds the value of about 3/1 (27 Kg/9 Kg) and staturates as the ratio reaches the value of 7/1 (32 Kg/4.5 Kg).

Figure 6:
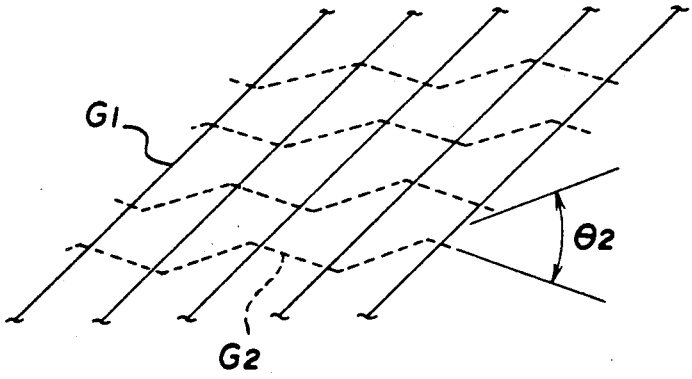
FIG. 6 is a perspective view of the zigzag position assumed by main and cross strings in the case of the tennis racket in accordance with the present invention.
Figure 10:
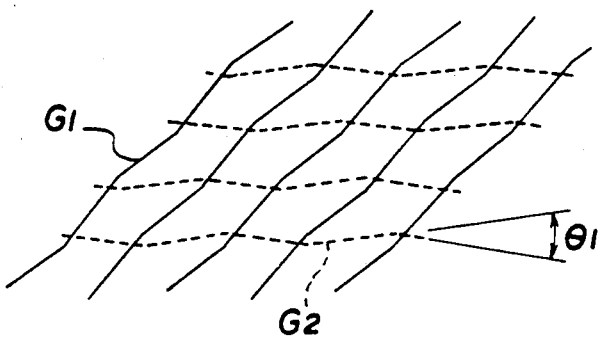
FIG. 10 PRIOR ART
FIG. 10 is a perspective view of the zigzag position assumed by main and cross strings in the case of a conventional tennis racket.

When this relationship between the main/cross string tension ratio ($T_1/T_2$) and the degree of spin performance is taken into consideration, the behaviour of the strings is believed to be much influenced by this relationship in addition to the above-discussed relationship in dynamic friction coefficient ($\mu_1 > \mu_2$) and relationship in normal reaction ($N_1 > N_2$). In construction of a racket face, each main string $G_1$ assumes a sort of zigzag position due to interlacing with associated cross strings $G_2$. This zigzag positions shown for the tennis racket of the present invention in FIG. 6 and for the conventional tennis racket in FIG. 10. When two illustrations are compared, the zigzag position angle of the main string $G_1$ in the present invention is smaller than the zigzag position angle $\theta_1$ of the main string $G_1$ in the conventional model. Stated otherwise, the main string $G_1$ in the present invention is more linear than that in the conventional model. Conversely, the zigzag position angle $\theta_2$ of the cross string $G_2$ in the present invention is larger than the zigzag position angle of the cross string $G_2$ in the conventional model. Stated otherwise, the cross string $G_2$ in the present invention is less linear than that in the conventional model.

Figure 7:
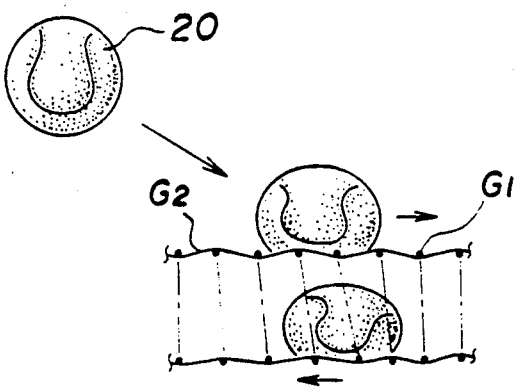
FIG. 7 is a side view of ball collision against the racket face at shooting balls.
Figure 8:
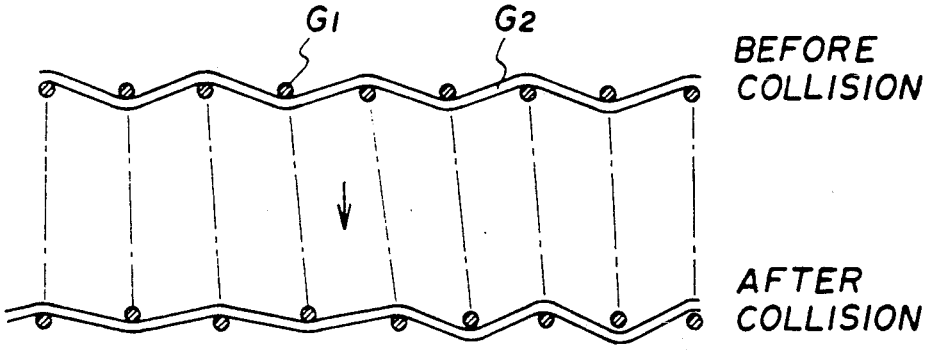
FIG. 8 is a sectional side view of the string displacement at shooting balls.

As a consequence, when a ball 20 collides against the racket face along an inclined course as shown in FIG. 7, the frictional force in the transverse direction causes displacement of the main strings $G_1$ and reduction in the frictional force causes restoration of the displacement. The frictional force in the transverse direction then acts to damp shocks in the tangential direction of the ball 20 and slippage between the ball and strings is thereby suppressed greatly.

In other words, the cross strings $G_2$ exhibit a sort of flexibility derived from their accordion line behaviour at collision against the ball. Following this behaviour of the cross strings $G_2$, the main strings $G_1$ also exhibit a sort of flexibility which damps shocks on the ball 20 thereby enhancing the spin performance at shooting balls.

The degree of shock-damping by flexibile behaviour of the main strings $G_1$ is proportional to the absolute value of the main string tension $T_1$ and the length $L_1$ of the main strings $G_1$. Uncontrolled increase in tension $T_1$ and/or reduction in length $L_1$, however, would cause undesirable degradation in spin performance. So, preferably, the main string tension $T_1$ is adjusted in a range from 27 to 41 Kg and the length $L_1$ of the main strings $G_1$ in a range from 320 to 390 mm.

Figure 9:
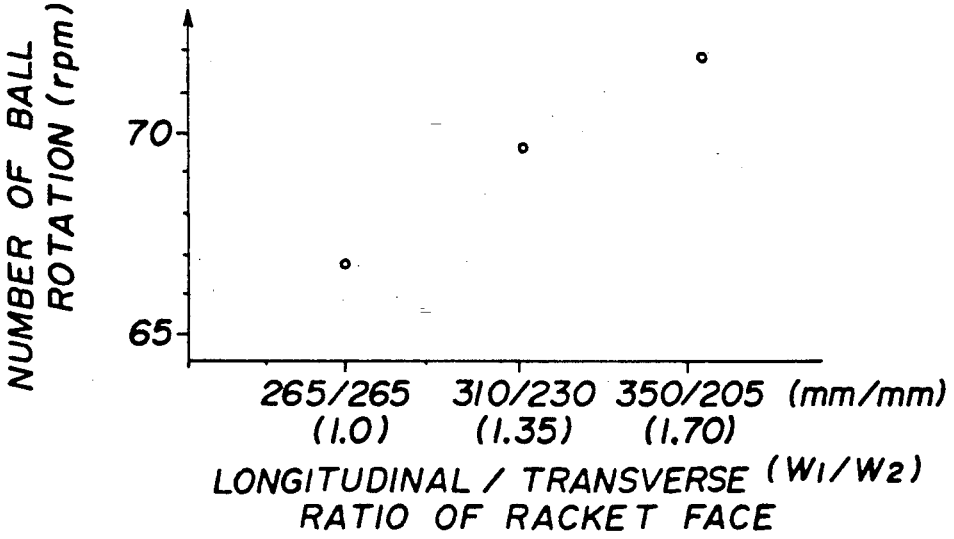
FIG. 9 is a graph for showing the relationship between the longitudinal/transverse ratio of a racket face and the spin performance of its head frame.

FIG. 9 depicts the relationship between the longitudinal/transverse ratio ($W_1/W_2$) of racket face and the spin performance of the head frame 11. For measurement, a ball 20 is thrown against a racket face at an angle of incidence of 45 degrees and at a speed of 110 Km/h. The main/cross string tension ratio $T_1/T_2$ is set to 7/1 (32 Kg/4.5 Kg). The spin performance is given in the form of number of ball rotation (rpm) after rebound. It is clear from this experimental results that a head frame 11 should preferably assume an oval-ring shape which is elongated in the longitudinal direction.

Figure 11:
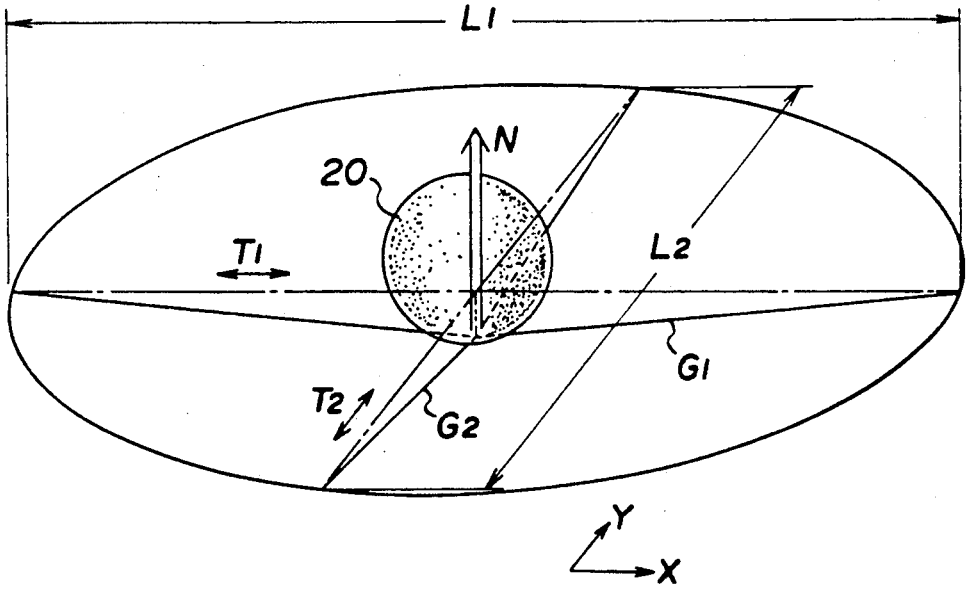
FIG. 11 is a perspective view of the typical mode of deformation of the main and cross strings at shooting balls.

The mode of deformation of the main and cross strings $G_1$, $G_2$ at shooting a ball 20 is typically shown in FIG. 11.

Figure 12:
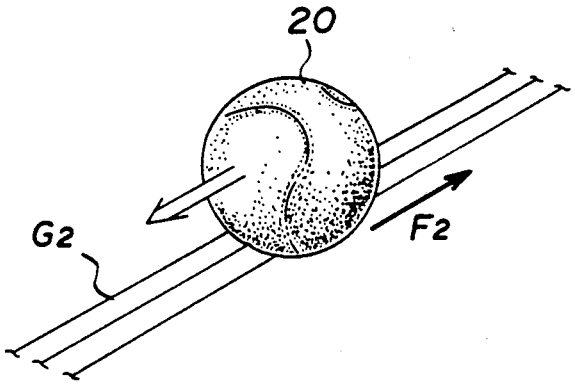
FIG. 12 is a perspective view of the mode of longitudinal friction between a ball and cross strings.
Figure 13:
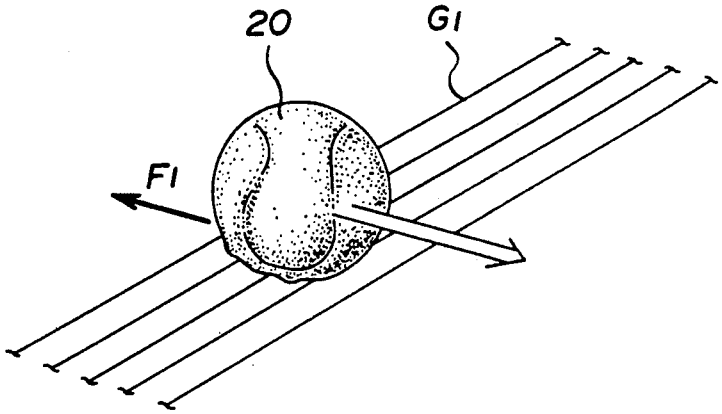
FIG. 13 is a perspective view of the mode of transverse friction between a ball and main strings.

The mode of longitudinal friction between a ball and cross strings $G_2$ is shown in FIG. 12 whereas the mode of transverse friction between a ball and main strings $G_1$ is shown in FIG. 13.

Figure 14:
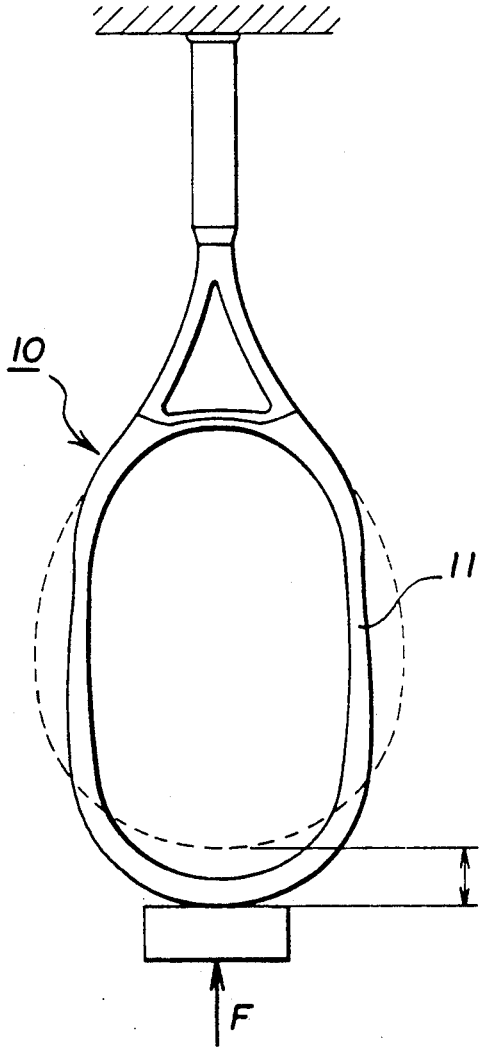
FIG. 14 is a side view of one example of the method for measurement of the compressive rigidity.

One example of the method for measurement of the compressive rigidity is shown in FIG. 14. A tennis racket 10 is fixed at the heel of its grip 13 and a load cell is mounted to its crown so that a load F is applied to the load cell in the direction of longitudinal compression. When the compressive deformation of the tennis racket 10 is $\Delta x$, the compressive rigidity K is given by;

$$K = F/\Delta x \tag{13}$$

The maximum face tension measurable by a tensioner currently available in the market is generally in a range from 4.5 to 36 Kg. When the longitudinal string tension $T_1$ is set to 36 Kg and the transverse string tension $T_2$ is set to 4.5 Kg using a tennis racket of 30 Kgf/mm compressive rigidity, the compressive deformation $\Delta x$ of the tennis racket 10 can be suppressed significantly. As a consequence, the resultant main/cross string tension $T_1/T_2$ approaches the value of the present invention, i.e. a value close to 3/1.

Figure 15:
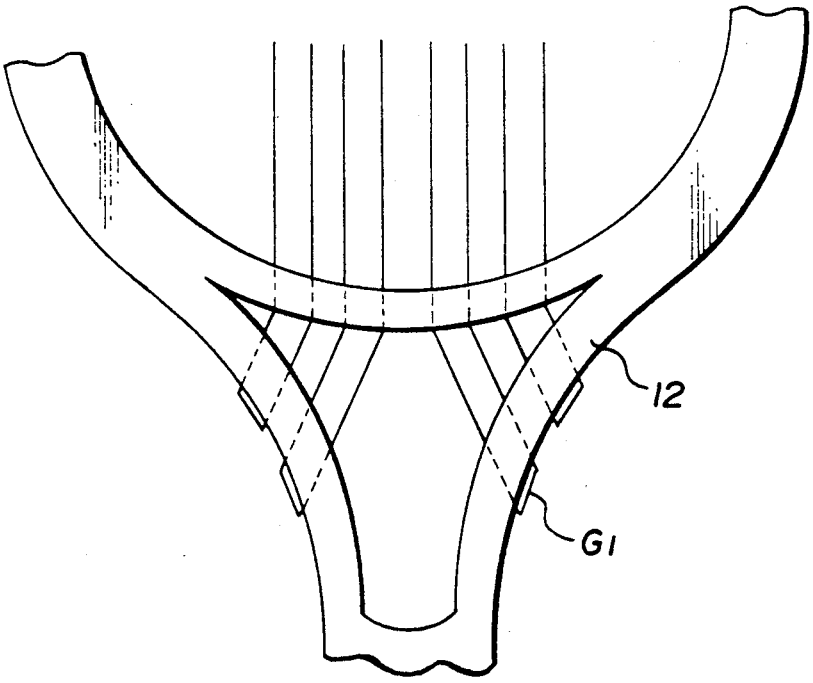
FIG. 15 is a plan view of one example of the throat of the tennis racket in accordance with the present invention.

Further, surface pressure on the racket face is closely related to better control on balls at shooting. The surface pressure should preferably be 3.1 Ksf/mm$^2$ or larger which is resulted by a main string tension of about 27 Kg and a cross string tension of about 9 Kg. Further, when the main strings $G_1$ are passed through the throat 12 as shown in FIG. 15, the yoke is firmly combined with the throat for increase in strength.

When the longitudinal/lateral ratio $W_1/W_2$ of the racket face and the compressive rigidity of the head frame are adjusted as specified in the basic concept of the present invention, the main/cross string tension ratio $T_1/T_2$ can be set to a value in a range from 3/1 to 15/1 even with a main string tension $T_1$ in a range from 27 to 41 Kg.

Under these conditions, the head frame is provided with a longitudinal compressive rigidity which assures a uniform stress distribution over the entire circumferential length and, as a consequence, the compressive deformation of the head frame in the longitudinal direction can be minimized remarkably.

I claim:

1. A tennis racket comprising a substantially oval ring shaped head frame and a racket face constructed by a string network which is made up of interlaced main and cross strings mounted under tension to said head frame, said racket face having a first length ($W_1$) in the direction of said main strings adjusted in a range from 320 to 390 mm and a second length ($W_2$) in the direction of said cross strings adjusted in a range from 200 to 240 mm and said head frame having a compressive rigidity in said direction of said main strings adjusted in a range from 30 to 200 Kgf/mm.

2. A tennis racket as claimed in claim 1 in which said head frame has a transverse cross sectional profile of a rigidity which provides a substantially constant stress distribution over its entire circumferential length when said main string tension ($T_1$) is 27 Kg or larger and said main/cross string tension ratio ($T_1/T_2$) is in a range from 3/1 to 15/1.

3. A tennis racket as claimed in claim 1 in which the size of said head frame taken in a direction parallel to said racket face in 18 mm or larger over a length of at least 20 mm within a circumferential area of 80 mm from its crown.

4. A tennis racket as claimed in claim 3 in which said size of said head frame is 20 mm or larger.

5. A tennis racket as claimed in claim 1 in which the size of said head frame taken in a direction parallel to said racket face is 16 mm or larger over a length of at least 20 mm within circumferential areas of 110 to 210 mm from its crown.

6. A tennis racket as claimed in claim 5 in which said size of said frame is 18 mm or larger.

7. A tennis racket as claimed in claim 1 in which the size of said head frame taken in a direction parallel to said racket face is 15 mm or larger within circumferential areas of 110 to 210 mm from the center of its yoke.

8. A tennis racket as claimed in claim 7 in which said size of said frame is 17 mm or larger.

9. A tennis racket as claimed in claim 1 in which the size of said head frame taken in a direction parallel to said racket face is 18 mm or larger over a length of at least 20 mm within a circumferential area of 80 mm from its crown, the size of said head frame taken in a direction parallel to said racket face in 16 mm or larger over a length of at least 20 mm within a circumferential area of 110 to 210 mm from said crown, the size of said head frame taken in a direction parallel to said racket face is 15 mm or larger within a circumferential area of 110 to 210 mm from the center of its yoke, and the size of the head frame taken in a directional parallel to the racket face is 18 mm or larger, over a length of at least 20 mm within a circumferential area of 80 mm from the center of its yoke.

10. A tennis racket as claimed in claim 1 in which the size of said head frame taken in a direction parallel to said racket face within a circumferential area of 80 mm from its crown is by 50% larger than the minimum size taken in a same way.

11. A tennis racket a claimed in claim 1 in which the size of said head frame taken in a direction parallel to said racket face within circumferential areas of 110 to 210 mm from its crown is by 50% larger than the minimum size taken in a same way.

12. A tennis racket as claimed in claim 1 in which the size of said head frame taken in a direction parallel to said racket face within circumferential areas of 110 to 210 mm from the center of its yoke is at least partially by 50% larger than the minimum size taken in a same way.

13. A tennis racket as claimed in claim 1 in which the size of said head frame taken in a direction parallel to said racket face within a circumferential area of 80 mm from its crown is by 50% larger than the minimum size taken in a same way, the size of said head frame taken in a direction parallel to said racket face within circumferential areas of 110 to 210 mm from said crown is by 50% larger than said minimum size, the size of said head frame taken in a direction parallel to said racket face within circumferential areas of 110 to 210 mm from the center of its yoke is at least partially by 50% larger than said minimum size, and/or the size of the head frame taken in a direction parallel to racket face within circumferential area of 80 mm from the center of its yoke is by 50% larger than the minimum size.

14. A tennis racket as claimed in claim 1 in which the length ($L_1$) of said main strings is chosen so that, within a first span ($S_1$) of 130 mm width extending equally on both sides of a longitudinal axis of symmetry, its minimum/maximum ratio is 90% or larger.

15. A tennis racket as claimed in claim 1 in which the length ($L_2$) of said cross strings is chosen so that, within a second span ($S_2$) of 200 mm width extending equally on both sides of a transverse axis of symmetry, its minimum/maximum ratio is 90% or larger.

16. A tennis racket as claimed in claim 1 in which the length ($L_1$) of said main strings is chosen so that, within a first span of 130 mm width extending equally on both sides of a longitudinal axis of symmetry, its minimum/maximum ratio is 90% or larger, and the length ($L_2$) of said cross strings is chosen so that, within a second span of 200 mm extending on both sides of a transverse axis of symmetry, its minimum/maximum ratio is 90% or larger.

* * * * *